US008297563B2

(12) United States Patent
Tsai

(10) Patent No.: US 8,297,563 B2
(45) Date of Patent: Oct. 30, 2012

(54) LIFTING DEVICE FOR CHAIR INCLUDING FORCE DISTRIBUTING PRESSING AND LOCKING SLEEVES

(76) Inventor: Po-Chuan Tsai, Tainan Hsien (TW)

( * ) Notice: Subject to any disclaimer, the term of this patent is extended or adjusted under 35 U.S.C. 154(b) by 347 days.

(21) Appl. No.: 12/728,386

(22) Filed: Mar. 22, 2010

(65) Prior Publication Data

US 2011/0226925 A1 Sep. 22, 2011

(51) Int. Cl.
*A47C 7/50* (2006.01)

(52) U.S. Cl. ..... 248/125.1; 248/218.4; 248/411; 248/412; 297/423.38

(58) Field of Classification Search ..... 248/411, 248/412, 161, 405, 125.8, 157, 188.1–188.2, 248/188.5, 354.3, 354.6, 230.2, 351, 354.4, 248/218.4, 125.1; 403/109.5, 374.1, 374.2, 403/109.1, 290; 297/344.18, 338, 423.38, 297/423.19; 108/147.18, 147.19, 148, 110
See application file for complete search history.

(56) References Cited

U.S. PATENT DOCUMENTS 519,311 A * 5/1894 Andrew et al. ..... 403/290
689,855 A * 12/1901 Copeland ..... 279/47
1,970,624 A * 8/1934 Recker ..... 248/412
2,532,168 A * 11/1950 Jakoubek ..... 254/101
3,458,234 A * 7/1969 Bates ..... 297/423.38
4,253,632 A * 3/1981 Doerner ..... 248/405
4,277,197 A * 7/1981 Bingham ..... 403/104
4,645,081 A * 2/1987 Korth ..... 211/196
4,867,406 A * 9/1989 Lengacher ..... 248/409
5,011,104 A * 4/1991 Fang ..... 248/125.8
5,984,567 A * 11/1999 Gollin et al. ..... 403/371
7,229,054 B2 * 6/2007 Hu ..... 248/188.1
7,387,343 B1 * 6/2008 Hsieh ..... 297/423.38
2009/0145056 A1 * 6/2009 Pereira ..... 52/111

* cited by examiner

*Primary Examiner* — Terrell McKinnon
*Assistant Examiner* — Ingrid M Weinhold
(74) *Attorney, Agent, or Firm* — Alan Kamrath; Kamrath IP Lawfirm, PA

(57) ABSTRACT

A lifting device for a chair includes an upright support post, a tapered locking sleeve adjustably mounted on the support post, a tapered pressing sleeve mounted on the locking sleeve, a stepping ring having a mounting tube which is mounted on the pressing sleeve, and a dustproof cover abutting a top of the mounting tube of the stepping ring and secured on a top of the pressing sleeve. Thus, the pressing sleeve surrounds the locking sleeve to distribute the pressing force evenly, and the locking sleeve surrounds the support post to distribute the pressing force evenly so as to prevent the pressing sleeve and the locking sleeve from being worn out or broken due to a stress concentration and to enhance the lifetime of the lifting device.

18 Claims, 6 Drawing Sheets

LIFTING DEVICE FOR CHAIR INCLUDING FORCE DISTRIBUTING PRESSING AND LOCKING SLEEVES

BACKGROUND OF THE INVENTION

1. Field of the Invention

The present invention relates to a lifting device and, more particularly, to a lifting device for a chair.

2. Description of the Related Art

A first conventional lifting device 1 for a chair in accordance with the prior art shown in FIGS. 5 and 6 comprises an upright support post 14, a C-shaped pressing tube 11 mounted on the support post 14, a stepping ring 15 having a central mounting sleeve 10 which is mounted on the pressing tube 11 and has a peripheral wall provided with a screw bore 12 connected to the pressing tube 11, and a threaded locking knob 13 screwed into the screw bore 12 of the mounting sleeve 10 and pressing the pressing tube 11 to lock the pressing tube 11 and the mounting sleeve 10 of the stepping ring 15 onto the support post 14. However, the locking knob 13 forces the pressing tube 11 in a single point so that the pressing tube 11 is easily worn out or broken due to a stress concentration.

A second conventional lifting device 2 for a chair in accordance with the prior art shown in FIGS. 7 and 8 comprises an upright support post 27, a tapered pressing ring 23 mounted on the support post 27 and having an upper end provided with an outer thread 28 and a lower end provided with a through hole 24 to receive a rubber plate 25 and a tapered pressing block 26, and a stepping ring having a central mounting sleeve 20 which is mounted on the pressing ring 23 and has an upper end provided with an inner thread 22 screwed onto the outer thread 28 of the pressing ring 23 and a lower end provided with a ramp 21 pressing the pressing block 26. Thus, the inner thread 22 of the mounting sleeve 20 is screwed onto the outer thread 28 of the pressing ring 23 so that when the mounting sleeve 20 is rotated relative to the pressing ring 23, the ramp 21 of the mounting sleeve 20 is moved to press the pressing block 26 and the rubber plate 25 toward the support post 27 to lock the pressing ring 23 onto the support post 27. However, dust or dirt easily enters the mounting sleeve 20 of the stepping ring to contaminate the pressing ring 23 and the pressing block 26, thereby affecting operation of the pressing ring 23 and the pressing block 26.

BRIEF SUMMARY OF THE INVENTION

In accordance with the present invention, there is provided a lifting device for a chair, comprising an upright support post, a tapered locking sleeve adjustably mounted on the support post, a tapered pressing sleeve mounted on the locking sleeve, a stepping ring having a mounting tube which is mounted on the pressing sleeve, and a dustproof cover abutting a top of the mounting tube of the stepping ring and secured on a top of the pressing sleeve.

According to the primary objective of the present invention, the pressing sleeve surrounds the locking sleeve to distribute the pressing force evenly, and the locking sleeve surrounds the support post to distribute the pressing force evenly so as to prevent the pressing sleeve and the locking sleeve from being worn out or broken due to a stress concentration and to enhance the lifetime of the lifting device.

According to another objective of the present invention, the locking sleeve forces the support post fully and completely so that the locking sleeve is locked onto the support post exactly and stably without producing vibration or sway.

According to a further objective of the present invention, the mounting tube of the stepping ring, the pressing sleeve and the locking sleeve are covered by the dustproof cover to prevent the dust or dirt from entering the mounting tube of the stepping ring and to facilitate operation of the pressing sleeve and the locking sleeve.

According to a further objective of the present invention, the user only needs to rotate the stepping ring to change the position of the stepping ring so that the height of the stepping ring can be adjusted easily and quickly.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
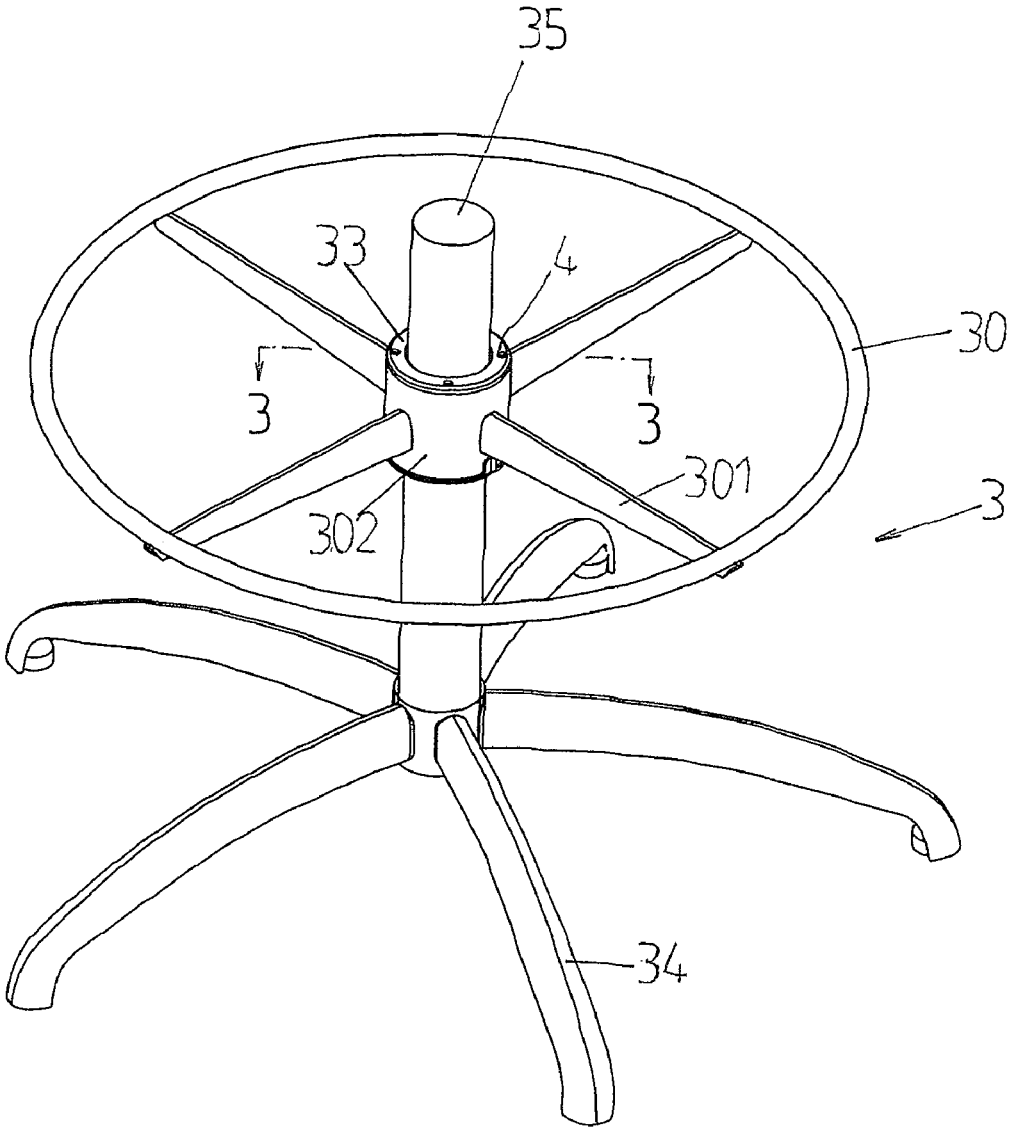
FIG. 1 is a perspective view of a lifting device for a chair in accordance with the preferred embodiment of the present invention.
Figure 2:
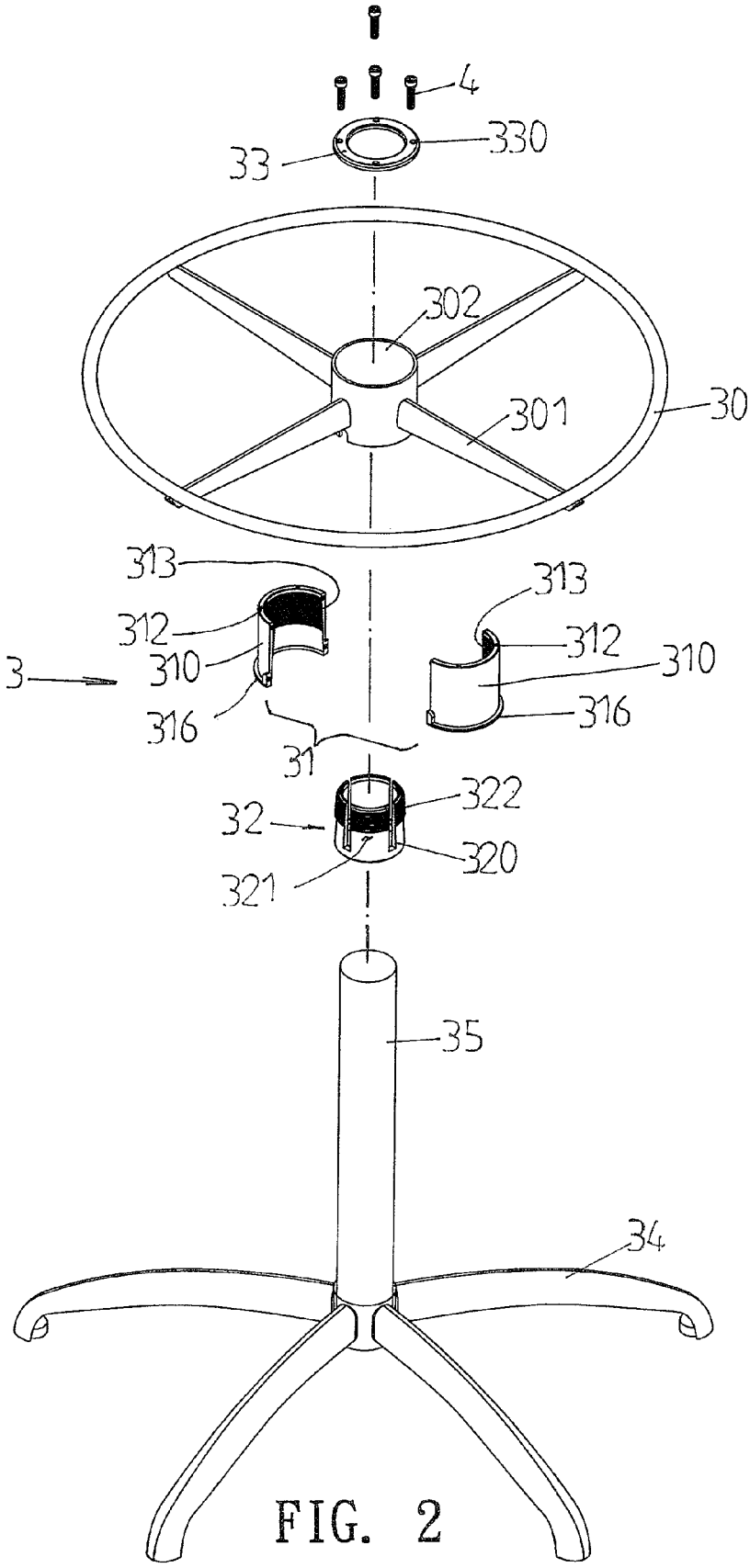
FIG. 2 is an exploded perspective view of the lifting device for a chair as shown in FIG. 1.
Figure 3:
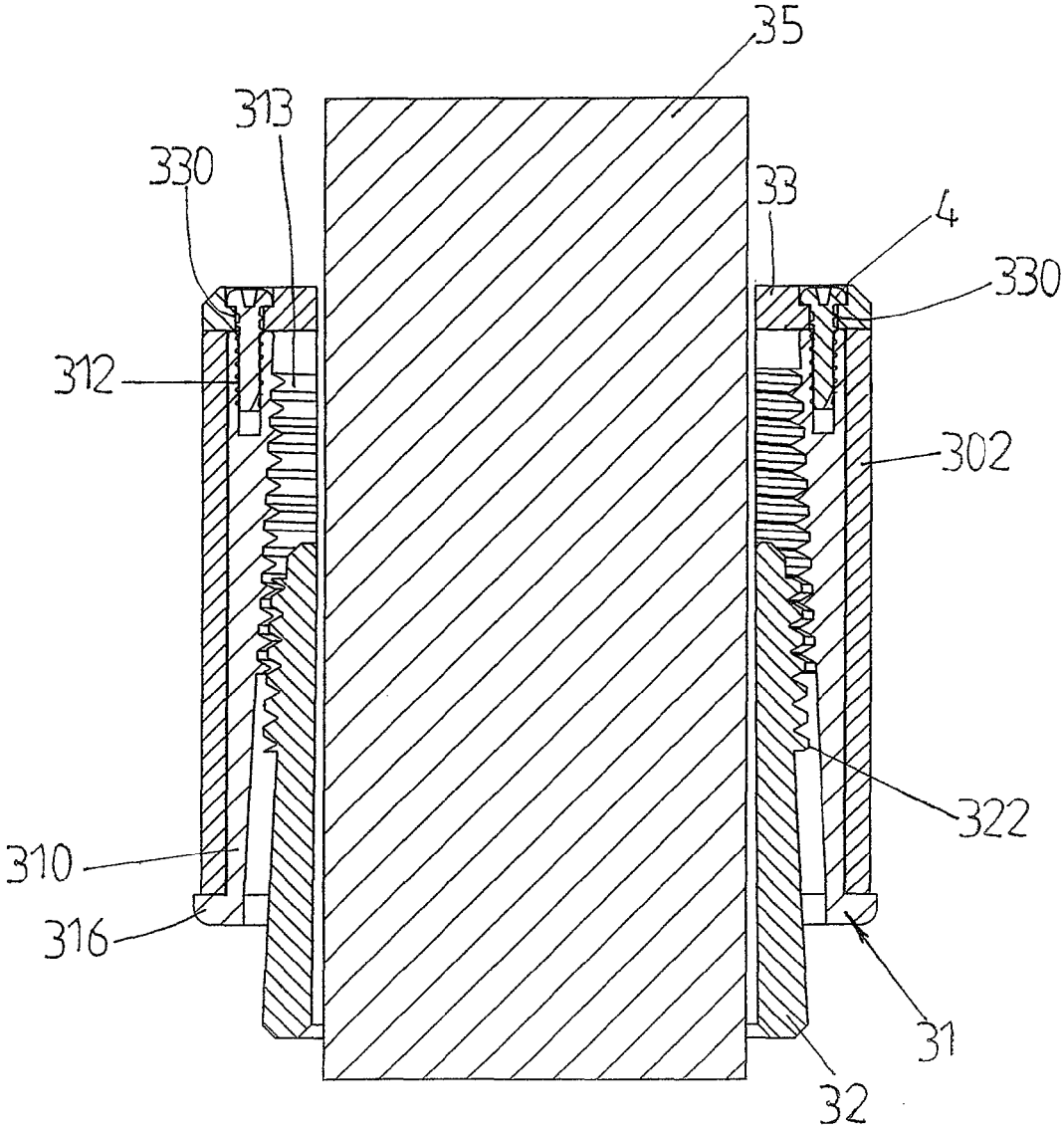
FIG. 3 is a front cross-sectional view of the lifting device for a chair taken along line 3-3 as shown in FIG. 1.

Referring to the drawings and initially to FIGS. 1-3, a lifting device 3 for a chair in accordance with the preferred embodiment of the present invention comprises an upright support post 35, a plurality of legs 34 mounted on a lower end of the support post 35, a tapered locking sleeve 32 adjustably mounted on the support post 35, a tapered pressing sleeve 31 mounted on the locking sleeve 32, a stepping ring 30 having a central portion provided with a mounting tube 302 which is mounted on the pressing sleeve 31, and a dustproof cover 33 abutting a top of the mounting tube 302 of the stepping ring 30 and secured on a top of the pressing sleeve 31.

The locking sleeve 32 surrounds the support post 35 and is located between the support post 35 and the pressing sleeve 31. The locking sleeve 32 has a taper angle matching that of the pressing sleeve 31. The locking sleeve 32 has an upper end provided with an outer threaded portion 322. The locking sleeve 32 has a peripheral wall provided with a plurality of elongate pressing pieces 321 and a plurality of elongate slits 320 defined between the pressing pieces 321 to make the pressing pieces 321 flexible. The pressing pieces 321 of the locking sleeve 32 are movable to press the support post 35 to lock the locking sleeve 32 onto the support post 35.

The pressing sleeve 31 surrounds the locking sleeve 32 and is located between the locking sleeve 32 and the mounting tube 302 of the stepping ring 30. The pressing sleeve 31 consists of two semi-cylindrical shells 310 which are juxtaposed to each other and combined together. Each of the two semi-cylindrical shells 310 of the pressing sleeve 31 has a tapered shape. The pressing sleeve 31 has an inner wall having an upper end provided with an inner threaded portion 313 screwed onto the outer threaded portion 322 of the locking sleeve 32. The top of the pressing sleeve 31 has a surface provided with a plurality of screw bores 312. The pressing sleeve 31 has a bottom provided with an enlarged stop flange 316 to stop the mounting tube 302 of the stepping ring 30. The stop flange 316 of the pressing sleeve 31 has an annular shape and extends radially and outwardly.

The stepping ring 30 has an inner portion provided with a cross-shaped support bracket 301 to support the mounting tube 302. The mounting tube 302 of the stepping ring 30 is located between the dustproof cover 33 and the stop flange 316 of the pressing sleeve 31. The top of the mounting tube 302 is located at a height flush that of the top of the pressing sleeve 31.

The dustproof cover 33 is secured on the top of the pressing sleeve 31 by a plurality of locking screws 4. The dustproof cover 33 has an annular shape and has a surface provided with a plurality of through holes 330 aligning with the screw bores 312 of the pressing sleeve 31 respectively. The locking screws 4 in turn extend through the through holes 330 of the dustproof cover 33 respectively and are screwed into the screw bores 312 of the pressing sleeve 31 respectively to lock the dustproof cover 33 onto the pressing sleeve 31.

Thus, the mounting tube 302 of the stepping ring 30, the pressing sleeve 31 and the locking sleeve 32 are covered by the dustproof cover 33. In addition, the pressing sleeve 31 is combined with the mounting tube 302 of the stepping ring 30 by the dustproof cover 33 so that the pressing sleeve 31 is driven by the mounting tube 302 of the stepping ring 30 and is rotatable relative to the locking sleeve 32.

Figure 4:
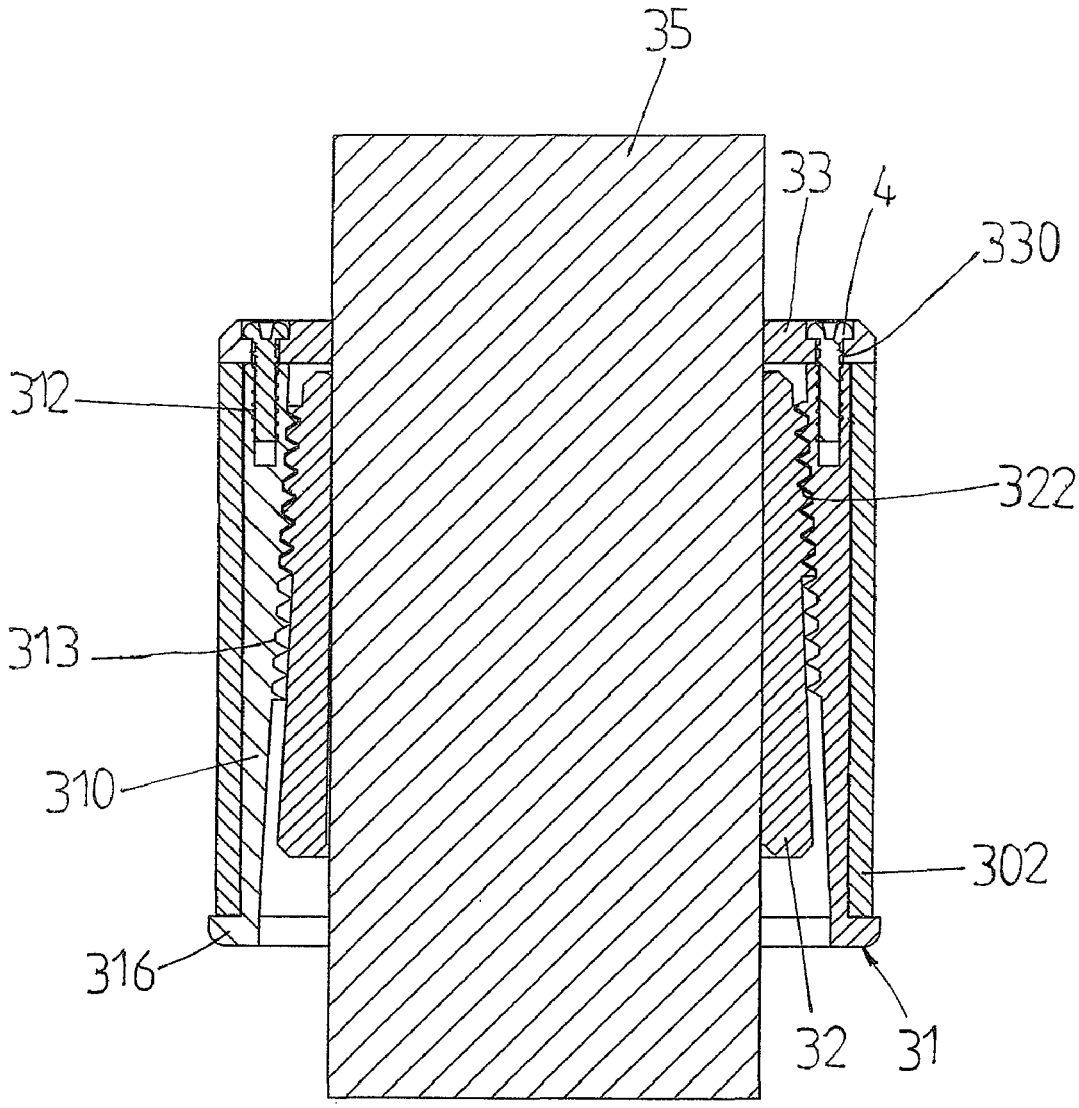
FIG. 4 is a schematic operational view of the lifting device for a chair as shown in FIG. 3.

In operation, referring to FIGS. 3 and 4 with reference to FIGS. 1 and 2, the lower end of the inner threaded portion 313 of the pressing sleeve 31 is screwed onto the upper end of the outer threaded portion 322 of the locking sleeve 32. At this time, the locking sleeve 32 is loosely fitted onto the support post 35 as shown in FIG. 3 so that the locking sleeve 32 is movable on the support post 35 to move the stepping ring 30 relative to the support post 35.

After the stepping ring 30 is moved to the desired position, the stepping ring 30 is rotated in the clockwise direction so that the mounting tube 302 of the stepping ring 30 and the pressing sleeve 31 are driven by the stepping ring 30 to rotate relative to the support post 35. At this time, the inner threaded portion 313 of the pressing sleeve 31 is screwed onto the outer threaded portion 322 of the locking sleeve 32 so that when the pressing sleeve 31 is rotated, the pressing sleeve 31 is moved downward relative to the locking sleeve 32. At the same time, the locking sleeve 32 has a taper angle matching that of the pressing sleeve 31 so that when the pressing sleeve 31 is moved downward relative to the locking sleeve 32, the pressing pieces 321 of the locking sleeve 32 are pressed by the pressing sleeve 31 to move toward and press the support post 35 as shown in FIG. 4 so as to lock the locking sleeve 32 onto the support post 35 and to fix the stepping ring 30 at the desired position.

Figure 5:
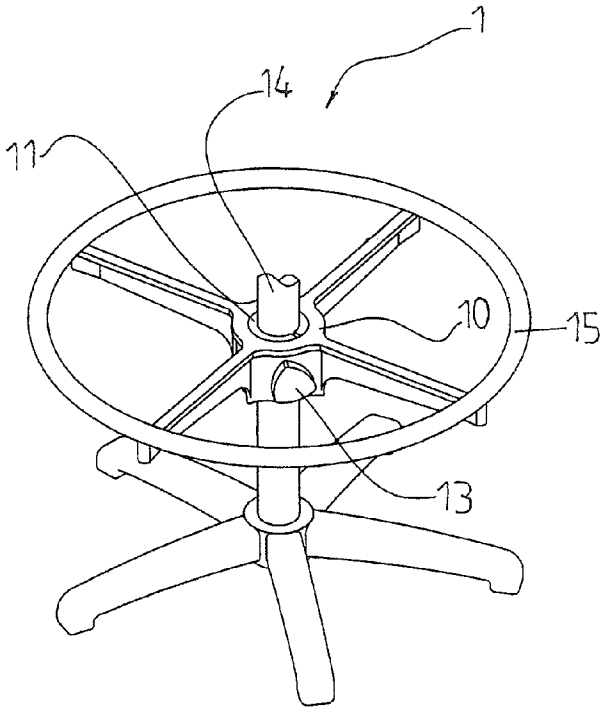
FIG. 5 PRIOR ART
FIG. 5 is a perspective view of a first conventional lifting device for a chair in accordance with the prior art.
Figure 6:
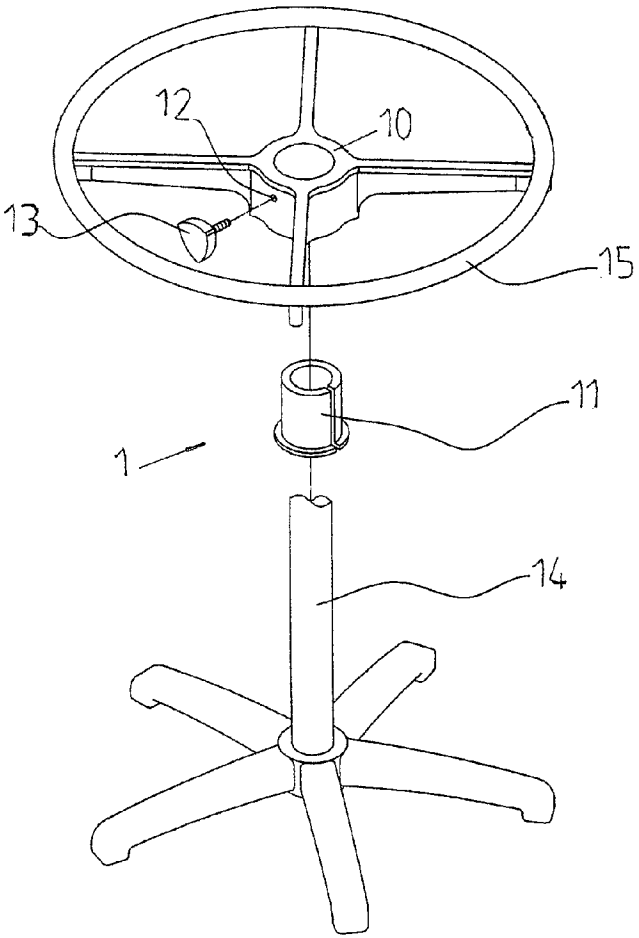
FIG. 6 PRIOR ART
FIG. 6 is an exploded perspective view of the first conventional lifting device for a chair as shown in FIG. 5.
Figure 8:
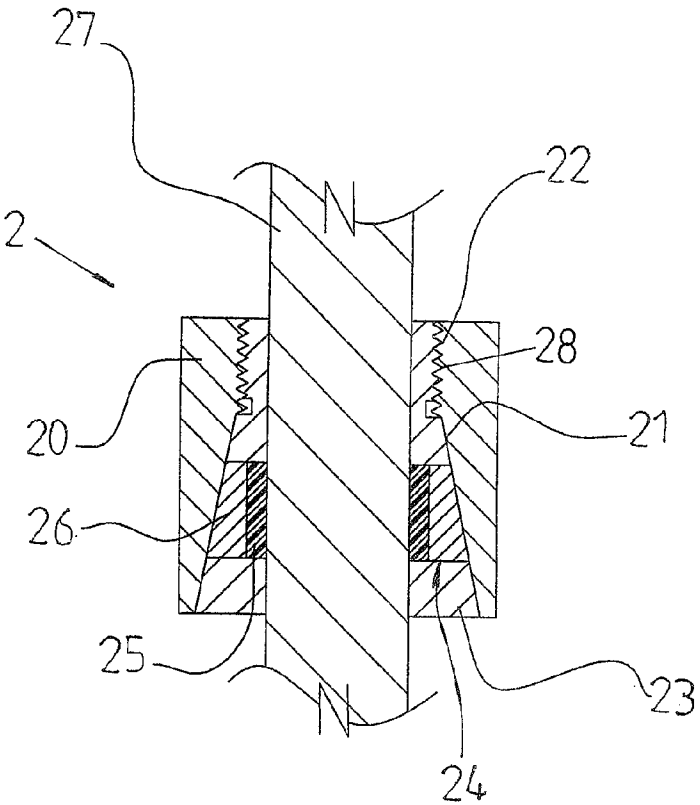
FIG. 8 PRIOR ART
FIG. 8 is a schematic operational view of the second conventional lifting device for a chair as shown in FIG. 7.
Figure 7:
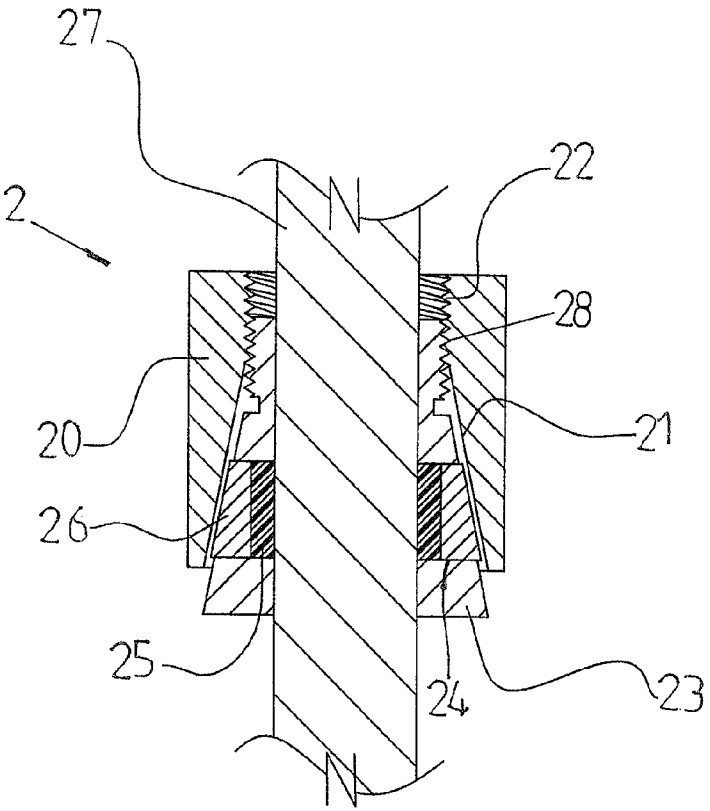
FIG. 7 PRIOR ART
FIG. 7 is a front cross-sectional view of a second conventional lifting device for a chair in accordance with the prior art.

When the user wishes to adjust the height of the stepping ring 30 again, the stepping ring 30 is rotated in the counterclockwise direction so that the pressing sleeve 31 is moved upward relative to the locking sleeve 32. Thus, the pressing pieces 321 of the locking sleeve 32 are loosened from the pressing sleeve 31 and are detached from the support post 35 as shown in FIG. 5 so as to unlock the locking sleeve 32 from the support post 35 so that the stepping ring 30 can be moved upward and downward to adjust the height of the stepping ring 30 again.

Accordingly, the pressing sleeve 31 surrounds the locking sleeve 32 to distribute the pressing force evenly, and the locking sleeve 32 surrounds the support post 35 to distribute the pressing force evenly so as to prevent the pressing sleeve 31 and the locking sleeve 32 from being worn out or broken due to a stress concentration and to enhance the lifetime of the lifting device 3. In addition, the locking sleeve 32 forces the support post 35 fully and completely so that the locking sleeve 32 is locked onto the support post 35 exactly and stably without producing vibration or sway. Further, the mounting tube 302 of the stepping ring 30, the pressing sleeve 31 and the locking sleeve 32 are covered by the dustproof cover 33 to prevent the dust or dirt from entering the mounting tube 302 of the stepping ring 30 and to facilitate operation of the pressing sleeve 31 and the locking sleeve 32. Further, the user only needs to rotate the stepping ring 30 to change the position of the stepping ring 30 so that the height of the stepping ring 30 can be adjusted easily and quickly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A lifting device for a chair comprising:

an upright support post;

a tapered locking sleeve adjustably mounted on the support post;

a tapered pressing sleeve mounted on the locking sleeve;

a stepping ring having a mounting tube which is mounted on the pressing sleeve; and a cover abutting a top of the mounting tube of the stepping ring and secured on a top of the pressing sleeve, wherein:

the locking sleeve has an upper end provided with an outer threaded portion; and the pressing sleeve has an inner wall having an upper end provided with an inner threaded portion screwed onto the outer threaded portion of the locking sleeve.

2. The lifting device for a chair of claim 1, wherein the locking sleeve has a peripheral wall provided with a plurality of elongate pressing pieces and a plurality of elongate slits defined between the plurality of elongate pressing pieces to make the plurality of elongate pressing pieces flexible.

3. The lifting device for a chair of claim 1, wherein the locking sleeve has a taper angle matching that of the pressing sleeve.

4. The lifting device for a chair of claim 1, wherein the pressing sleeve comprises two semi-cylindrical shells juxtaposed to each other and combined together.

5. The lifting device for a chair of claim 4, wherein each of the two semi-cylindrical shells of the pressing sleeve has a tapered shape.

6. The lifting device for a chair of claim 1, wherein the cover is secured on the top of the pressing sleeve by a plurality of locking screws.

7. The lifting device for a chair of claim 6, wherein:

the top of the pressing sleeve has a surface provided with a plurality of screw bores;

the cover has a surface provided with a plurality of through holes aligning with the plurality of screw bores of the pressing sleeve respectively; and the plurality of locking screws in turn extends through the through holes of the cover respectively and is screwed into the screw bores of the pressing sleeve respectively to lock the cover onto the pressing sleeve.

8. The lifting device for a chair of claim 1, wherein the cover has an annular shape.

9. The lifting device for a chair of claim 1, wherein the locking sleeve surrounds the support post.

10. The lifting device for a chair of claim 1, wherein the locking sleeve is located between the support post and the pressing sleeve.

11. The lifting device for a chair of claim 1, wherein the pressing sleeve surrounds the locking sleeve.

12. The lifting device for a chair of claim 1, wherein the pressing sleeve is located between the locking sleeve and the mounting tube of the stepping ring.

13. A lifting device for a chair comprising:

an upright support post;

a tapered locking sleeve adjustably mounted on the support post;

a tapered pressing sleeve mounted on the locking sleeve;

a stepping ring having a mounting tube which is mounted on the pressing sleeve; and a cover abutting a top of the mounting tube of the stepping ring and secured on a top of the pressing sleeve, wherein:

the pressing sleeve has a bottom provided with an enlarged stop flange to stop the mounting tube of the stepping ring; and the mounting tube of the stepping ring is located between the cover and the stop flange of the pressing sleeve.

14. The lifting device for a chair of claim 13, wherein the stop flange of the pressing sleeve has an annular shape and extends radially and outwardly.

15. The lifting device for a chair of claim 1, wherein the top of the mounting tube is located at a height flush with the top of the pressing sleeve.

16. The lifting device for a chair of claim 1, wherein the mounting tube of the stepping ring, the pressing sleeve and the locking sleeve are covered by the cover.

17. The lifting device for a chair of claim 2, wherein the plurality of elongate pressing pieces of the locking sleeve are pressed by the pressing sleeve and are movable to press the support post to lock the locking sleeve onto the support post.

18. The lifting device for a chair of claim 1, wherein the pressing sleeve is combined with the mounting tube of the stepping ring by the cover, and wherein the pressing sleeve is driven by the mounting tube of the stepping ring and is rotatable relative to the locking sleeve.

* * * * *